US010780598B2

(12) United States Patent
Park et al.

(10) Patent No.: US 10,780,598 B2
(45) Date of Patent: Sep. 22, 2020

(54) RAZOR CARTRIDGE AND RAZOR USING SAME

(71) Applicant: DORCO CO., LTD., Seoul (KR)

(72) Inventors: Young Ho Park, Seoul (KR); Sung Hee Son, Seoul (KR); Jun Soo Chang, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 15/342,879

(22) Filed: Nov. 3, 2016

(65) Prior Publication Data

US 2017/0136639 A1 May 18, 2017

Related U.S. Application Data

(63) Continuation of application No. PCT/KR2014/007897, filed on Aug. 25, 2014.

(30) Foreign Application Priority Data

Aug. 25, 2014 (KR) ..... 10-2014-0110833

(51) Int. Cl.
*B26B 21/56* (2006.01)
*B26B 21/14* (2006.01)
(Continued)

(52) U.S. Cl.
CPC ..... *B26B 21/565* (2013.01); *B26B 21/06* (2013.01); *B26B 21/14* (2013.01); *B26B 21/225* (2013.01);
(Continued)

(58) Field of Classification Search
CPC ..... B26B 21/40; B26B 21/4006; B26B 21/54; B26B 21/56; B26B 21/565; B26B 21/22;
(Continued)

(56) References Cited

U.S. PATENT DOCUMENTS 5,687,485 A 11/1997 Shurtleff et al.
5,761,814 A 6/1998 Anderson et al.
(Continued)

FOREIGN PATENT DOCUMENTS

CN 1048441 C 1/2000
CN 102164722 B 4/2014
(Continued)

OTHER PUBLICATIONS

Extended European search report with supplementary European search report and the European search opinion issued by the European Patent Office for corresponding European Patent Application No. 14900371.7, dated Nov. 20, 2017.
(Continued)

*Primary Examiner* — Evan H MacFarlane
(74) *Attorney, Agent, or Firm* — Lee, Hong, Degerman, Kang & Waimey PC

(57) ABSTRACT

A razor cartridge includes a housing, a guard, a cap and a plurality of razor blades installed between the guard and cap in the housing, each blade including a base portion, a bent portion extending from an end of the base portion, and an edge portion extending from an end of the bent portion with a cutting edge formed at an end of the edge portion, wherein a first distance between a straight line extending from the front of the base portion and an end point of the cutting edge is in the range of 0.3 to 1.0 mm, wherein an overlap size defined as a distance by which the first distance of one of the razor blades is overlapped by an adjacent razor blade located behind the razor blade when the adjacent razor blade is projected in the vertical direction is less than or equal to 0.5 mm.

8 Claims, 13 Drawing Sheets

(51) Int. Cl.

| | |
|---|---|
| ***B26B 21/54*** | (2006.01) |
| ***B26B 21/40*** | (2006.01) |
| ***B26B 21/06*** | (2006.01) |
| ***B26B 21/22*** | (2006.01) |
| ***B26B 21/28*** | (2006.01) |

(52) U.S. Cl.
CPC ..... *B26B 21/28* (2013.01); *B26B 21/4031* (2013.01); *B26B 21/54* (2013.01); *B26B 21/56* (2013.01)

(58) Field of Classification Search
CPC ... B26B 21/222; B26B 21/225; B26B 21/227; B26B 21/28; B26B 21/52; B26B 21/14; B26B 21/4031; B26B 21/06
USPC ..... 30/346.55, 346.57, 346.6, 356, 47–53
See application file for complete search history.

(56) References Cited

U.S. PATENT DOCUMENTS

| | | | | |
|---|---|---|---|---|
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,225,510 | B2 | 7/2012 | Peterson et al. | |
| 9,862,108 | B2 * | 1/2018 | Davos | B26B 21/14 |
| 2005/0198837 | A1 | 9/2005 | Rawle | |
| 2006/0026842 | A1 | 2/2006 | Gilder et al. | |
| 2009/0083982 | A1 * | 4/2009 | Forsdike | B26B 21/225 30/34.2 |
| 2009/0193659 | A1 * | 8/2009 | Park | B26B 21/225 30/50 |
| 2010/0077617 | A1 | 4/2010 | Peterson et al. | |
| 2011/0232100 | A1 | 9/2011 | Park et al. | |
| 2012/0132036 | A1 * | 5/2012 | Bykowski | B21D 5/042 76/116 |
| 2012/0159787 | A1 | 6/2012 | Luxton | |
| 2012/0317818 | A1 * | 12/2012 | Oglesby | B26B 21/4018 30/77 |
| 2013/0205595 | A1 | 8/2013 | Bykowski et al. | |
| 2014/0026424 | A1 | 1/2014 | Oglesby et al. | |
| 2015/0013169 | A1 | 1/2015 | Warrick | |
| 2015/0101195 | A1 * | 4/2015 | Long | B26B 21/4031 30/41.5 |
| 2017/0203451 | A1 * | 7/2017 | Griffin | B26B 21/4031 |

FOREIGN PATENT DOCUMENTS

| | | | |
|---|---|---|---|
| EP | 2 823 942 | A1 | 1/2015 |
| JP | 9-502912 | A | 3/1997 |
| JP | 2007-525310 | A | 9/2007 |
| JP | 2009542305 | A | 12/2009 |
| JP | 2012-502779 | A | 2/2012 |
| KR | 10-2006-0023995 | A | 3/2006 |
| KR | 10-0749925 | B1 | 8/2007 |
| KR | 10-2010-0049665 | A | 5/2010 |
| WO | 2009/040765 | A1 | 4/2009 |

OTHER PUBLICATIONS

International Search Report issued for corresponding International application No. PCT/KR2014/007897 dated May 19, 2015, with an English translation.
Office Action issued by the Japan Patent Office for corresponding Japanese Patent Application No. 2017-510279, dated Sep. 12, 2017, with concise explanation in English, and English translation retrieved from the global dossier.
Office Action issued by the State Intellectual Property Office of China for corresponding Chinese Patent Application No. 201480079022.X, dated Nov. 16, 2017, with concise explanation in English, and English translation retrieved from the global dossier.

* cited by examiner

RAZOR CARTRIDGE AND RAZOR USING SAME

TECHNICAL FIELD

The present disclosure relates to a razor cartridge and a razor using the same, and more particularly, to a razor cartridge in which adjacent razor blades form a narrow span and a small overlap size to improve rinsability of a razor and shaving comfort and a razor using the razor cartridge.

BACKGROUND ART

It is important for a wet razor not to cause nicks and cuts while providing a smooth and neat shave in close contact with the skin. Factors that affect the shaving performance of the wet razor include the frictional resistance between a cutting edge of a razor blade and the skin and the degree of sharpness of the cutting edge. These factors are generally related to a cutting force applied to hair by a razor blade.

An increase in the number of razor blades in a razor generally improves the shaving efficiency of the razor and the distribution of a pressing force on the skin but increases a drag force. In addition, an increase in the number of razor blades increases an area occupied by the razor blades or reduces a distance (a span) between cutting edges of the razor blades.

However, an increase in the area occupied by the razor blades increase the drag force, thus adversely affecting the shaving performance. In addition, a narrow span between the razor blades makes a smooth shave possible but reduces rinsability because shaving residues get caught between the razor blades or causes the so-called 'double engagement' problem. Conversely, a wide span between the razor blades improves the rinsability of the razor and reduces the likelihood of the double engagement but increases the risks of nicks and cuts in the skin.

In this regard, the number of razor blades and the span between the razor blades for optimum shaving are being researched. Here, the double engagement refers to a phenomenon in which two or more razor blades simultaneously engage with the same hair. The double engagement can cause a user to feel tight during shaving.

In addition, a conventional razor blade consists of a support with high rigidity and a blade with a cutting edge mounted on the support. In the conventional razor blade, however, the support is formed thick in order to increase the rigidity of the support. Accordingly, the number of razor blades that can be installed in a razor is limited, and a gap between the razor blades cannot be made narrow. Even if the gap between the razor blades is made narrow, rinsability is too low.

In addition, in the conventional razor blade, the blade and the support are manufactured separately and then coupled to each other by a welding process. This increases the production cost of the razor and reduces production efficiency due to the additional process.

Accordingly, it is essential to make razor blades thin in order to reduce the gap between the razor blades, maintain shaving performance, and easily remove shaving residues. However, too thin razor blades are unable to properly cut hair on the skin, are easily deformable and have poor durability. Therefore, thin razor blades with high rigidity are being researched.

DISCLOSURE

Technical Problem

Provided are a razor cartridge in which adjacent razor blades form a narrow span and a small overlap size to improve rinsability of a razor and shaving comfort and a razor using the razor cartridge.

Provided are a razor cartridge which employs thin, one-piece razor blades with improved rigidity obtained by embodying the geometrical structure of a razor blade and a razor using the razor cartridge.

Additional aspects will be set forth in part in the description which follows and, in part, will be apparent from the description, or may be learned by practice of the presented embodiments.

Technical Solution

According to an aspect of an embodiment, a razor cartridge includes a housing which comprises a guard and a cap; and a plurality of razor blades which are installed between the guard and the cap in the housing and each of which comprises a base portion, a bent portion extending from an end of the base portion, and an edge portion extending from an end of the bent portion and having a cutting edge formed at an end of the edge portion, wherein an overlap size defined as a distance by which the first distance of one of the razor blades is overlapped by an adjacent razor blade located behind the razor blade when the adjacent one of the razor blades is projected in the vertical direction ranges more than 0 and less than or equal to 0.5 mm.

In addition, according to an aspect of an embodiment, a razor includes the razor cartridge; and a handle attached to the razor cartridge.

Advantageous Effects

A razor cartridge and a razor employing the same according to the inventive concept provide at least one of the following advantages.

Since adjacent razor blades form a narrow span and an overlap size within an appropriate range, the rinsability of a razor and shaving comfort can be improved. In addition, it is possible to provide thin razor blades with improved rigidity by embodying the geometrical structure of a razor blade and increase production efficiency by providing razor blades formed as a single piece.

However, the effects are not restricted to the one set forth herein. The above and other effects will become more apparent to one of daily skill in the art by referencing the claims.

DESCRIPTION OF DRAWINGS

These and/or other aspects will become apparent and more readily appreciated from the following description of the embodiments, taken in conjunction with the accompanying drawings in which.

BEST MODE

This present invention comprises a housing which comprises a guard and a cap; and a plurality of razor blades which are installed between the guard and the cap in the housing and each of which comprises a base portion, a bent portion extending from an end of the base portion, and an edge portion extending from an end of the bent portion and having a cutting edge formed at an end of the edge portion, wherein a first distance X between the straight line extending from the front of the base portion and the end point of the cutting edge is in the range of 0.3 to 1.0 mm, wherein an overlap size L defined as a distance by which the first distance X of one of the razor blades is overlapped by an adjacent one of the razor blades located behind the razor blade when the adjacent razor blade is projected in the vertical direction ranges more than 0 and less than or equal to 0.5 mm.

MODE FOR INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will filly convey the scope of the invention to those skilled in the art. The same reference numbers indicate the same components throughout the specification.

Unless defined otherwise, all technical and scientific terms used herein have the same meaning as commonly understood by one of ordinary skill in the art to which this invention belongs. It is noted that the use of any and all examples, or exemplary terms provided herein is intended merely to better illuminate the invention and is not a limitation on the scope of the invention unless otherwise specified. Further, unless defined otherwise, all terms defined in generally used dictionaries may not be overly interpreted.

Figure 1:
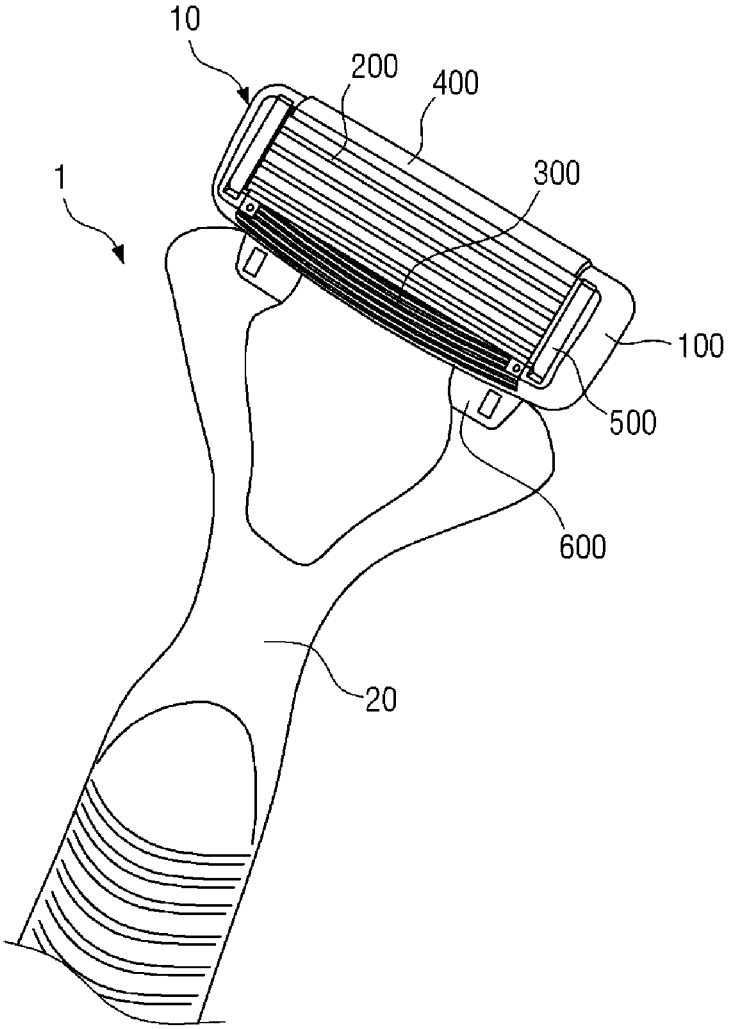
FIG. 1 is a perspective view of a razor equipped with a razor cartridge according to an embodiment.
Figure 2:
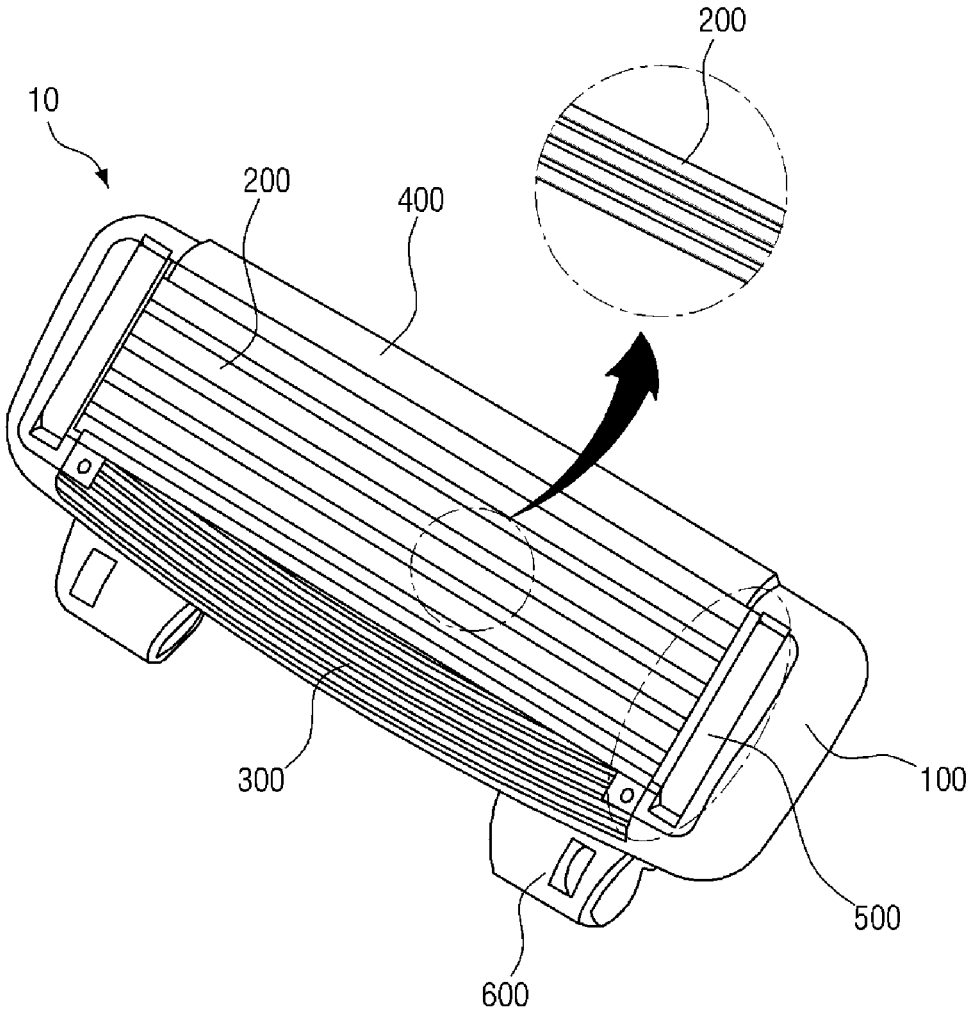
FIG. 2 is a perspective view of a razor cartridge according to an embodiment.

FIG. 1 is a perspective view of a razor equipped with a razor cartridge according to an embodiment. FIG. 2 is a perspective view of a razor cartridge according to an embodiment.

Referring to FIGS. 1 and 2, a razor 1 according to an embodiment includes a razor cartridge 10 and a handle 20.

The handle 20 is a component that allows a user to hold the razor 1. The handle 20 is generally detachably attached to the razor cartridge 10 but can also be formed integrally with the razor cartridge 10. In addition, since the razor 1 is a wet razor, it frequently comes into contact with water. Therefore, the handle 20 may include an anti-slip portion (not illustrated) which provides a relatively greater frictional force than the other portions of the handle 20 in order to prevent the user's hand from slipping off the handle 20.

The razor cartridge 10 is detachably and pivotably attached to the handle 20 by a connector 600. However, the razor cartridge 10 can also be detachably, but not pivotably, attached to the handle 20. Therefore, the razor cartridge 10 can be detached from the handle 20 and replaced by a new razor cartridge as the user desires.

The razor cartridge 10 includes a housing 100 and a plurality of razor blades 200. In addition, the razor cartridge 10 may further include a rubber strip 300, a lubricating band 400, a clip 500, and the connector 600.

The housing 100 forms the outer shape of the razor cartridge 10 and forms an internal space in which the razor blades 200 are installed. In addition, the housing 100 may include installation grooves (not illustrated) into which ends of the razor blades 200 in a horizontal direction (a Z-axis direction in FIG. 3) are inserted. Since the installation grooves cause the razor blades 200 to be inserted with a certain degree of frictional force, they can prevent the movement of the inserted razor blades 200 to a certain degree. The number of the installation grooves formed may correspond to the number of the razor blades 200. For example, if seven razor blades 200 are installed in the housing 100, seven installation grooves may be formed.

In an embodiment, the installation grooves may be omitted. In this case, the razor blades 200 may be fixed and/or installed in the housing using wire wrapping, cold forming, insert molding, adhesives, etc. However, other assembling methods known to those of ordinary skill in the art can also be used.

The housing 100 includes a guard 100*a* disposed in front of a foremost razor blade 200*a* among the razor blades 200 and a cap 100*b* disposed behind a rearmost razor blade 200*g*. Here, the term 'front' denotes a shaving direction, and the term 'rear' denotes a direction opposite to the shaving direction.

The guard 100*a* and the cap 100*b* are integrally formed with the housing. However, the guard 100*a* and the cap 100*b* can also be formed as separate components and then coupled to the housing 100. In addition, the guard 100*a* and the cap 100*b* may be made of the same material as the housing 100 or a different material from the housing 100. Since a virtual plane P1 (see FIG. 8) that connects the guard 100*a* and the cap 100*b* defines a virtual shaving plane P1 (see FIG. 8) during shaving, the guard 100*a* and the cap 100*b* may be made of a hard material (such as plastic) having more than a certain degree of hardness. The rubber strip 300 located in front of the guard 100*a* may be made of a flexible material having elasticity. Therefore, the rubber strip 300 can pull the skin and arrange hair during shaving. That is, the rubber strip 300 increases shaving efficiency by lifting, in advance, hairs on the skin that comes into contact with the razor blades 200 during shaving. Accordingly, the razor blades that follow the rubber strip 300 can easily cut the hairs on the skin.

The rubber strip 300 consists of a plurality of fins. Since the fins are made of a flexible material, they are pressed down to the virtual shaving plane P1 during shaving. The rubber strip 300 may also be made of an elastic material. For example, the rubber strip 300 may be made of a rubber material, a silicone material, etc. The rubber strip 300 made of a more flexible material than that of the housing 100 may be coupled to the front of the housing 100.

The lubricating band 400 may be coupled to the rear of the cap 100*b* in the housing. The lubricating band 400 provides a lubricating material to the skin during shaving, thus making smooth shaving possible. In addition, the lubricating band 400 may include a shaving aid, a shaving aid composite for delivering a lubricating material to the user's skin, etc. The lubricating band 400 tends to become more lubricative in a wet condition than in a dry condition.

The rubber strip 300 and the lubricating band 400 may be coupled to the housing 100 or integrally formed with the housing 100. For example, the rubber strip 300 may be injection-molded as a part of the housing 100. However, the rubber strip 300 can also be formed in the housing 100 by insert molding or co-injection molding.

The clip 500 is a component for preventing the separation of the razor blades 200 from the housing 100. The clip 500 may be coupled to at least one of both ends of each of the razor blades 200 in the horizontal direction (the Z-axis direction). To fix both ends of the razor blades 200 in a widthwise direction to the housing 100 in such a way as to cover the ends, the clip 500 passes through openings at both ends of the housing 100 and is bent at a lower surface of the housing 100.

The razor blades 200 are components that are installed in the internal space of the housing 100 and cut hair extending from the user's skin. As both ends of the razor blades 200 in the horizontal direction (the Z-axis direction) are inserted into the installation grooves, the razor blades 200 may be coupled to the housing 100. In addition, the clip 500 may be coupled to both ends of the razor blades 200 in the horizontal direction. Accordingly, the razor blades 200 can be securely installed in the housing 100 because the separation of the razor blades 200 from the housing 100 is prevented by the clip 500.

Figure 3:
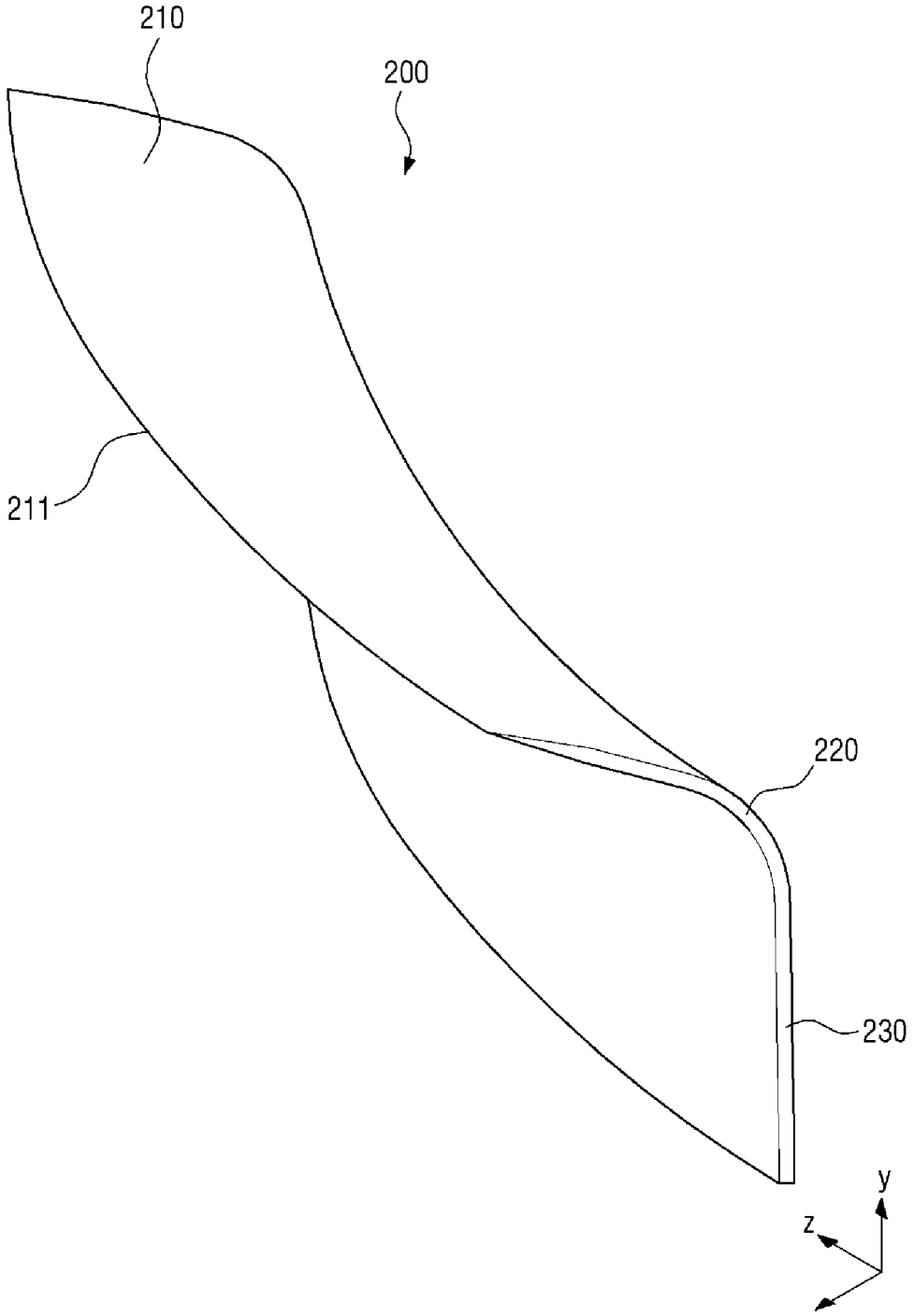
FIG. 3 is a perspective view of a razor blade of the razor cartridge according to an embodiment.
Figure 4:
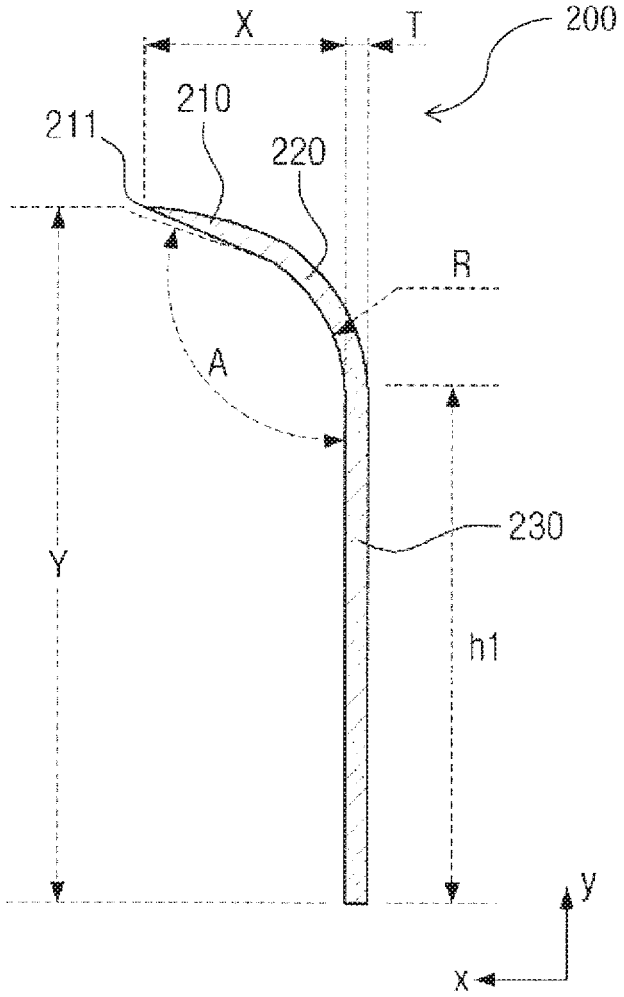
FIG. 4 is a side cross-sectional view of the razor blade of the razor cartridge according to an embodiment.
Figure 5A:
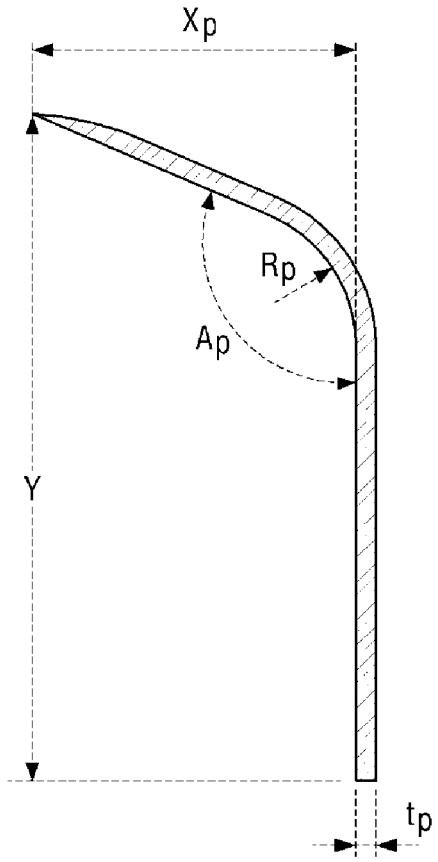
FIG. 5A [Prior Art]
FIG. 5A is a side cross-sectional view showing geometrical characteristics of a razor blade according to a conventional razor blade.
Figure 5B:
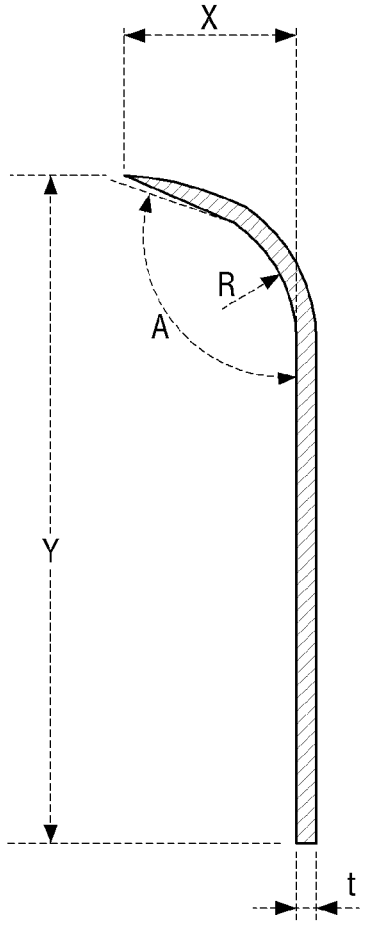
FIG. 5B is a side cross-sectional view showing geometrical characteristics of a razor blade according to an embodiment.

FIG. 3 is a perspective view of a convexly curved razor blade according to an embodiment. FIG. 4 is a side cross-sectional view of the razor blade according to an embodiment. For simplicity and clarity, the configuration of the blades only at the cross-section is shown. FIGS. 5A and 5B are a side cross-sectional views comparing geometrical characteristics of a razor blade according to an embodiment and a conventional razor blade.

Generally, a razor blade 200 should be rigid enough to cut hair (not illustrated). If the razor blade is not rigid enough, it may be displaced by a force applied during shaving. The displacement of the razor blade may reduce the shaving performance of the razor blade or cause a user to be hurt by the razor blade. Accordingly, it is very important for a razor blade according to the inventive concept to be thin and rigid enough. It is also very important to find out a geometrical shape and disposition characteristics (of razor blades) that enable a plurality of thin razor blades to be mounted in a razor cartridge of a limited size and ensure high shaving performance and rinsability.

Referring to FIGS. 3 and 4, a razor blade 200 includes a base portion 230, a bent portion 220 which extends from an end of the base portion 230 to be bent, and an edge portion 210 which ends from an end of the bent portion 220.

A conventional razor blade uses a blade (not illustrated) mounted on a support (not illustrated). To support the blade, the support is formed to a thickness of more than 0.1 mm. Generally, the conventional razor blade is formed to a thickness of between 0.1 mm and 0.2 mm. Since the support has a large thickness t, it is difficult to obtain a narrow span. On the other hand, the razor blade 200 according to the embodiment can be formed to a thickness t of 0.1 mm or less because the edge portion 210, the bent portion 220 and the base portion 230 are integrally formed with each other. Accordingly, a narrow span Sn can be obtained. The razor blade 200 having a thickness t of less than 0.05 mm is unable to secure sufficient rigidity. Thus, the razor blade 200 cannot properly perform its functions. For this reason, the thickness t of the razor blade should be in the range of 0.05 to 0.1 mm. In this range, a certain degree of rigidity can be secured, and a narrow span can be obtained. In particular, it has been experimentally proven that the thickness t of 0.07 to 0.08 mm ($0.07\ mm \le t \le 0.08\ mm$) ensures sufficient rigidity and a narrow span Sn.

All of the edge portion 210, the bent portion 220 and the base portion 230 excluding a cutting edge 211 may have the same thickness, or at least one of the edge portion 210, the bent portion 220 and the base portion 230 may have a different thickness. The razor blade 200 is manufactured by bending a plane on which the cutting edge is formed. In this bending process, the front of the bent portion 220 contracts, whereas the rear of the bent portion 220 expands. Here, since the rear of the bent portion 220 undergoes a greater change than the front, the thickness of the bent portion 220 is reduced in order to maintain the volume of the bent portion 220 constant. Therefore, the base portion 230 may be thicker than the bent portion 220.

The base portion 230 has an end connected to the bent portion 220 and supports the bent portion 220 and the edge portion 210. In addition, the base portion 230 is disposed parallel to a vertical direction (a Y-axis direction) of the razor blade. The base portion 230 may be formed to a thickness of 0.075 mm and may be a little thicker than the bent portion 220 as mentioned above.

A distance h1 of the base portion 230 in the vertical direction may be in the range of 1.7 to 2.1 mm ($1.7\ mm \le Y1 \le 2.1\ mm$) and may be higher than the support of the conventional razor blade (by about 1.5 mm). Assuming that the razor blade has a fixed length, the greater the distance h1 of the base portion 230 in the vertical direction, the smaller the first distance X which will be described later.

The bent portion 220 extends from an end of the base portion 230 to be bent. The bent portion 220 has an inner radius of curvature R of 0.3 to 1.2 mm ($0.3\ mm \le R \le 1.2\ mm$). Here, the inner radius of curvature R denotes a radius of curvature of the front of the bent portion. As the inner radius of curvature increases, the degree of bending decreases.

In an example, the inner radius of curvature R of the bent portion 220 may be in the range of 0.3 to 0.45 mm ($0.3\ mm \le R \le 0.45\ mm$). However, when the inner radius of curvature R of the bent portion 220 is in the range of 0.3 to 0.45 mm, cracks are more likely to occur during the bending operation. Therefore, the bending portion 220 may be heat-treated in order to prevent the occurrence of cracks.

In another example, the inner radius of curvature R of the bent portion 220 may satisfy the condition that 0.45 mm≤R≤0.9 mm. In this case, even if not heat-treated, the bent portion 220 may not have cracks during the bending operation.

The bent portion 220 extends from an end of the base portion 230 at an angle A of 90 to 120 degrees. Accordingly, the edge portion 210 and the base portion 230 form the angle A of 90 to 120 degrees. Since the angle A is related to an angle at which hair (not illustrated) and the edge portion 210 meet during shaving, it is closely related to shaving performance.

In an example, the bent portion 220 may extend from the base portion 230 at an angle of 105 to 115 degrees. Accordingly, an acute angle at which the edge portion 210 and hair meet may be in the range of 15 to 25 degrees. In this case, the hair can be cut effectively.

The edge portion 210 includes an end at which the cutting edge 211 is formed and the other end which is connected to the bent portion 220. Here, the cutting edge 211 is used to cut hair.

The edge portion 210 forms an angle of 90 to 120 degrees with the base portion 230. Accordingly, an acute angle at which the edge portion 210 and hair meet may be in the range of 0 to 30 degrees. In particular, superior shaving performance can be achieved when the acute angle at which the edge portion 210 and the hair meet is in the range of 15 to 25 degrees. Therefore, the angle A formed by the edge portion 210 and the base portion 230 may be in the range of 105 to 115 degrees (105 degrees≤A≤115 degrees). According to the results of experiments on the shaving performance of razor blades, the best shaving performance is achieved when the angle A formed by the edge portion 210 and the base portion 230 is in the range of 106 to 108 degrees (106 degrees≤A≤108 degrees). Therefore, the angle A formed by the edge portion 210 and the base portion 230 may be most preferably in the range of 106 to 108 degrees (106 degrees≤A≤108 degrees).

In the razor blade 200, the edge portion 210, the bent portion 220 and the base portion 230 are integrally formed with each other. If the razor blade 200 is formed as a single piece, the thickness of the razor blade 200 can be reduced while a work process of the razor blade 200 is reduced. However, if the razor blade 200 is formed thin as a single piece, it is required to ensure sufficient rigidity of the razor blade 200.

Therefore, to ensure sufficient rigidity of the razor blade 200, the first distance X between a straight line extending from the front of the base portion 230 in the vertical direction (the Y-axis direction) and an end point of the cutting edge 211 is reduced in the razor blade 200 compared with the conventional razor blade. It should be noted that the first distance X is defined as a distance from the base portion 230 to an end of the cutting edge 211 measured when the base portion 230 is erected in a perpendicular direction. When the razor blade 200 is actually mounted in the razor cartridge, the base portion 230 does not necessarily face the perpendicular direction. If the base portion 230 of the razor blade 200 is mounted obliquely in the housing 100 (see FIG. 2), a horizontal distance between the edge portion 210 and the bent portion 220 is different from the first distance X according to the inventive concept. That is, the first distance X according to the inventive concept is determined solely by the geometrical shape of the razor blade without consideration of the state in which the razor blade is mounted in the razor cartridge 10 (see FIG. 2). The reason why the first distance X is defined based on the assumption that the base portion 230 faces the perpendicular direction is to prevent the base portion 230 from affecting the other portions of the razor blade which move as a cantilever. That is, since the base portion 230 faces the perpendicular direction, i.e., a direction perpendicular to the contact plane P1 in this case, it only receives a compressive force from the skin that comes into contact with the razor cartridge 10 (see FIG. 2) and does not bring about a cantilever effect.

A reduction in the first distance X increases the resistance (i.e., rigidity) of the cutting edge 211 to a force acting on the razor blade during shaving. This is because, in a case where a portion including the edge portion 210 and the bent portion 220 of the razor blade 200 is considered as a cantilever, the deformation of the cantilever by an external force is reduced by a reduction only in a length of the cantilever even if a size or thickness of a cross-section of the cantilever remains unchanged.

Therefore, the first distance X between the straight line extending from the front of the base portion 230 of the razor blade 200 in the vertical direction (the Y-axis direction) and the end point of the cutting edge 211 is in the range of 0.3 to 1.0 mm. The first distance X smaller than 0.3 mm may make it difficult to secure the edge portion 210 even minimally due to the basic size of the bent portion 220. The first distance X greater than 1.0 mm may make it difficult to secure sufficient rigidity of the thin razor blade.

In particular, according to the results of experiments on the rinsing efficiency of razors conducted within the range of the first distance X at intervals of 0.05 mm, the first distance X in the range of 0.3 to 0.85 mm can secure at least a minimum span even if a plurality of razor blades are installed in a cartridge of a limited size. Therefore, the rinsing efficiency can be maintained at more than an appropriate level. The rinsing efficiency is better when the first distance X is in the range of 0.3 to 0.75 mm than in other ranges, and the optimum rinsing efficiency can be achieved when the first distance X is about 0.7 mm.

The first distance of the conventional razor blade and that of the razor blade according to the embodiment will now be compared with reference to Table 1 below and FIGS. 5A and 5B. Here, FIG. 5A illustrates a conventional razor blade, and FIG. 5B illustrates a razor blade according to an embodiment. The conventional razor blade shown in FIG. 5A includes elements similar to those of the razor blade according to the present disclosure shown in FIG. 5B, including an inner radius of curvature $R_p$, angle $A_p$ between the end of the base portion and the bent portion, and razor blade thickness tp, which may or may not vary from those of the present disclosure, as discussed further below. Table 1 shows some of the geometrical characteristics of conventional razor blades and razor blades according to the inventive concept.

Referring to FIG. 5B and Table 1, the first distances X of razor blades 200 according to the inventive concept are distributed in the range of 0.37 to 0.86 mm, that is, roughly in the range of about 0.3 to about 1 mm. On the other hand, the first distances Xp of conventional razor blades (see FIG. 5A) are distributed in the range of 1.15 to 1.54 mm. That is, the first distances Xp of the conventional razor blades are all greater than 1.0 mm.

TABLE 1

| | X | Y |
|---|---|---|
| Conventional razor blade sample 1 | 1.27 mm | 2.45 mm |
| Conventional razor blade sample 2 | 1.15 mm | 1.83 mm |
| Conventional razor blade sample 3 | 1.54 mm | 3.10 mm |
| Razor blade sample 1 according to the inventive concept | 0.37 mm | 2.22 mm |

TABLE 1-continued

| | X | Y |
|---|---|---|
| Razor blade sample 2 according to the inventive concept | 0.61 mm | 2.40 mm |
| Razor blade sample 3 according to the inventive concept | 0.77 mm | 2.45 mm |
| Razor blade sample 4 according to the inventive concept | 0.86 mm | 2.51 mm |

To see if the rigidity of a razor blade 200 is improved by a reduction in the first distance X of the razor blade 200, a test was conducted by applying an external force onto Conventional razor blade sample 1 of Table 1 and Razor blade sample 3 according to the inventive concept of Table 1. In this test, Conventional razor blade sample 1 (FIG. 5A) and Razor blade sample 3 according to the inventive concept (FIG. 5B) had the same thickness ($t_p$, t), radius of curvature ($R_p$, R), angle ($A_p$, A) and second distance Y (height) but different first distances (Xp, X). The first distance Xp of Conventional razor blade sample 1 (FIG. 5A) was 1.27 mm, and the first distance X of Razor blade sample 3 according to the inventive concept (FIG. 5B) was 0.77 mm.

As a result, the conventional razor blade was deformed by about −0.0081 mm in the vertical direction (the Y-axis direction) and by about +0.0065 mm in a front-to-back direction (an X-axis direction), whereas the razor blade according to the inventive concept was deformed by about −0.0041 mm in the vertical direction (the Y-axis direction) and by about +0.0039 mm in the front-to-back direction (the X-axis direction). As apparent from the above test result, a short first distance improves the rigidity of a razor blade.

Figure 6A:
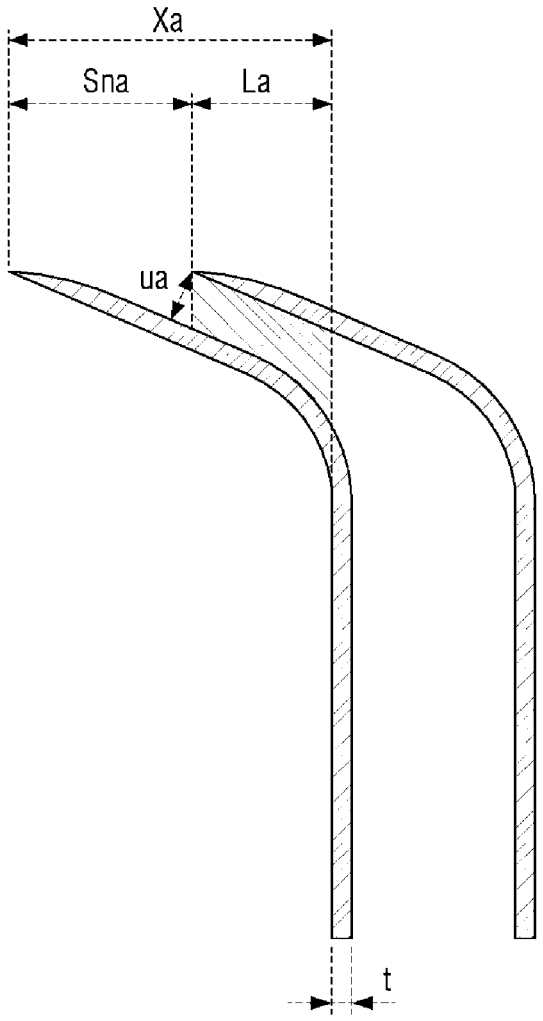
FIG. 6A [Prior Art]
FIG. 6A is a side cross-sectional view showing a first distance, a span and an overlap distance formed by two adjacent conventional razor blades.
Figure 6B:
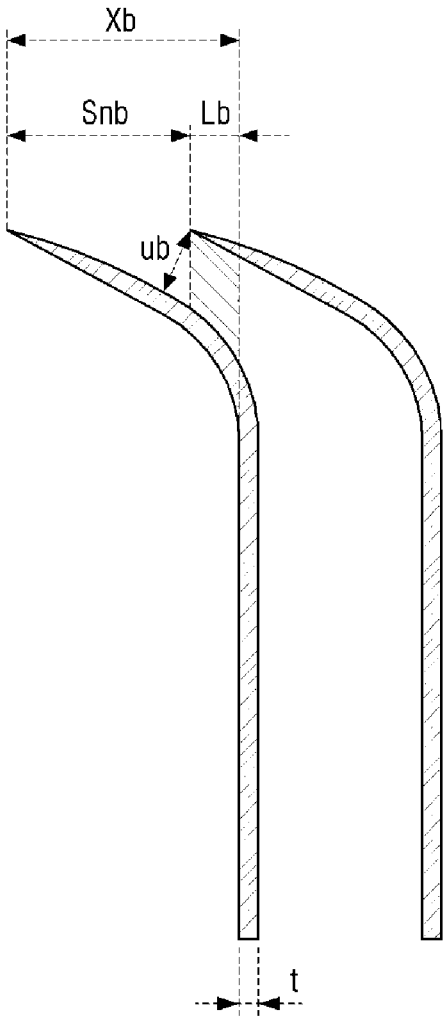
FIG. 6B is a side cross-sectional view showing a first distance, a span and an overlap distance formed by two adjacent razor blades according to an embodiment.
Figure 7A:
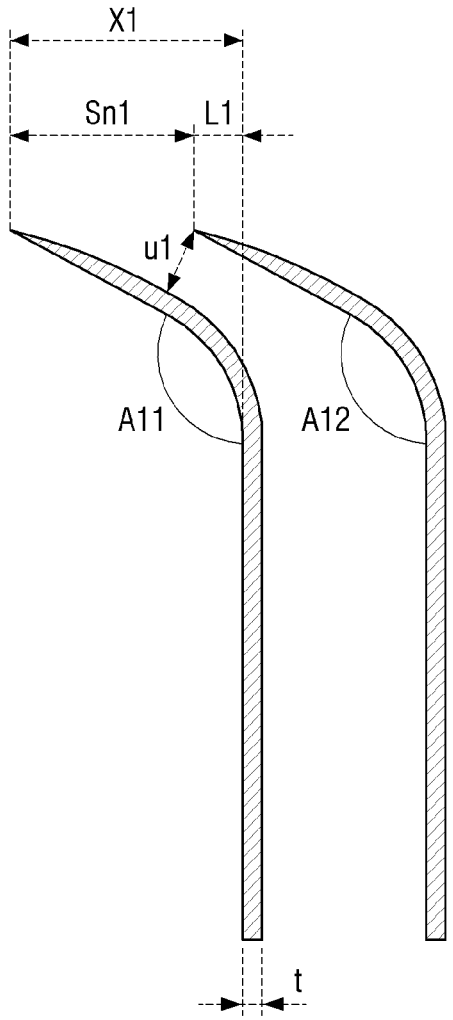
FIG. 7A is a side cross-sectional view showing tunnel sizes according to angles A11 and A12 of razor blades according to an embodiment.
Figure 7B:
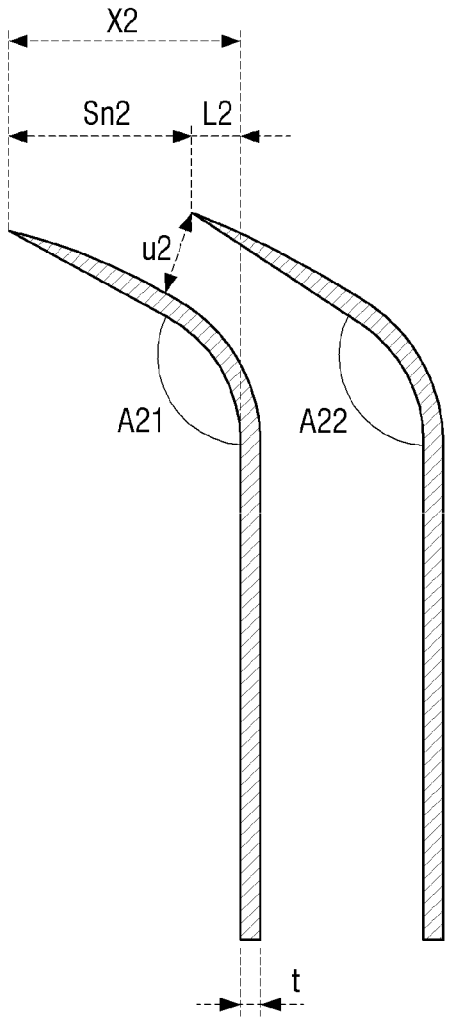
FIG. 7B is a side cross-sectional view showing tunnel sizes according to angles A21 and A22 of razor blades according to an embodiment.
Figure 8A:
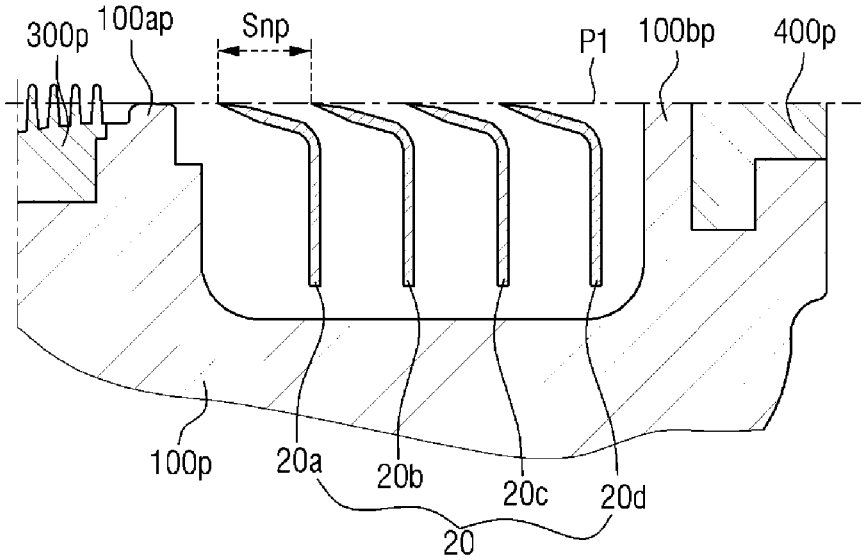
FIG. 8A [Prior Art]
FIG. 8A is a side cross-sectional view of a conventional razor cartridge.
Figure 8B:
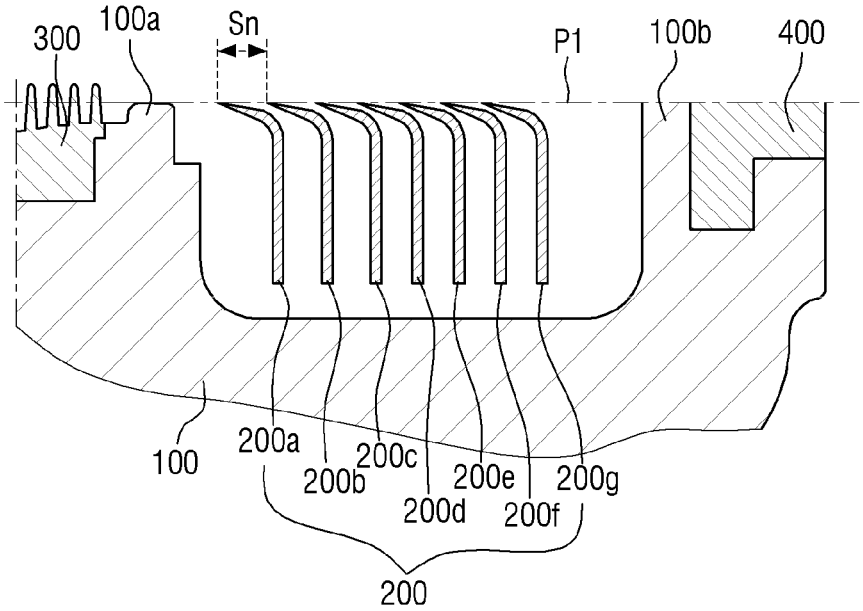
FIG. 8B is a side cross-sectional view of a razor cartridge according to an embodiment.

FIGS. 6A and 6B are side cross-sectional views comparing a first distance, a span and an overlap distance formed by two adjacent razor blades according to an embodiment with those formed by two adjacent conventional razor blades. FIGS. 7A and 7B are side cross-sectional views comparing tunnel sizes according to angles of razor blades according to an embodiment. FIGS. 8A and 8B are side cross-sectional views of a razor cartridge according to an embodiment comparing to prior art.

With the development of razor technology, the number of razor blades is increasing. Although 4- or 6-blade razor cartridges are now used most widely, 7- or more blade razor cartridges such as the one illustrated in FIG. 8B will be introduced in the future. Assuming that the size of a razor cartridge, in particular, the size of the razor cartridge in the front-to-back direction is limited, the number of razor blades installed in the razor cartridge can be increased by reducing the thickness of the razor blades. However, the reduced thickness of the razor blades reduces the rigidity of the razor blades. Therefore, the first distance is reduced in a razor blade according to the inventive concept in order to ensure a certain degree of rigidity as described above.

If the number of razor blades is increased despite the limited size of the cartridge, a span between the razor blades is reduced naturally. In this case, it may be possible to install a large number of razor blades in the razor cartridge, but the reduced span causes various problems. Therefore, the razor cartridge should be designed in view of such problems. Here, the span generally refers to a distance Sn (for example, shown in FIG. 8B) between cutting edges of adjacent razor blades. It has been theorized that the span affects a shaving process in various ways. Specifically, the span can control the degree of bulging of the skin (convex of skin) between razor blades. For example, a narrow span reduces the bulging of the skin during shaving, thus improving the comfort of the skin. However, the narrow span reduces the rinsing efficiency of a razor. In addition, a wide span improves the rinsing efficiency of the razor but increases the bulging of the skin, thus reducing the comfort of the skin.

Hereinafter, a razor cartridge design for improving the rinsing efficiency of a razor despite a narrow span formed by the installation of many razor blades will be described with reference to FIGS. 6A through 8B.

Referring to FIGS. 8A and 8B, a span Sn of razor blades 200*a* through 200*g* installed in the razor cartridge according to an embodiment in FIG. 8B is formed narrower than the span Snp of conventional razor blades 20*a* through 20*d* installed in a conventional razor cartridge in FIG. 8A. Thus, a razor cartridge 10 including razor blades 200 according to this invention can comprise seven razor blades or more, for example 200*a* through 200*g*, even though a conventional razor cartridge comprises four razor blades 20*a* through 20*d*.

Referring to FIG. 8A, a plurality of razor blades 20 are included in a razor cartridge 100*p* in the conventional art, and the razor blades 20 may be installed between a guard 100*ap* and a cap 100*bp* in a housing 100*p* which may include a lubricating band 400*p* and a rubber strip 300*p*. Similarly, referring to FIG. 8B, a plurality of razor blades 200 are included in a razor cartridge 10 according to an embodiment of the present disclosure. The razor blades 200 are installed between a guard 100*a* and a cap 100*b* in a housing 100 which may include a lubricating band 400 and a rubber strip 300. For example, seven razor blades 200 may be installed in the housing 100. If a relatively large number of razor blades 200 are installed in the razor cartridge 10, they may form a narrow span Sn. Accordingly, the rinsing efficiency of a razor may be reduced.

The narrow span Sn reduces the rinsing efficiency of the razor because it increases an overlap area (hatched areas in FIG. 6A and FIG. 6B) between adjacent razor blades 200. Here, the overlap area (the hatched areas in FIG. 6A and FIG. 6B) denotes an area of an edge or bent portion of a razor blade which is covered by an edge portion of a razor blade located behind the razor blade. When the overlap area increases, the rinsing efficiency of the razor may be reduced according to the increase in the overlap area. An overlap size L, as a measure of the size of the overlap area, may be defined as a distance between a straight line extending from the front of a base portion of a razor blade along the base portion and an end point of a cutting edge of an adjacent razor blade located behind the razor blade. In addition, the overlap size may be defined as a distance by which the first distance X of a razor blade is overlapped by an adjacent razor blade located behind the razor blade when the adjacent razor blade is projected in the vertical direction. The overlap size defined here has the same meaning as the overlap size L defined earlier.

Therefore, as the overlap size L increases, the overlap area also increases. Hence, the resistance area of the razor blades increases until shaving residues and/or a rinsing solution introduced between adjacent razor blades are discharged between base portions of the razor blades, thereby reducing the rinsing efficiency of the razor. To reduce the overlap size L, it is important to reduce the first distances X of the razor blades 200. If the first distances X of the razor blades 200 are reduced, an area of a razor blade which is covered by an adjacent razor blade located behind the razor blade, that is, an overlap area is reduced. Accordingly, the overlap size L formed by the adjacent razor blades is reduced, thereby improving the rinsing efficiency of the razor.

The narrow span Sn and the reduced overlap size L achieved by a reduction in the first distances X of the razor blades 200 will now be described below.

Referring first to FIGS. 6A and 6B before the description, when there is an overlap between two adjacent razor blades, the first distance Xa, Xb is the sum of the span Sna, Snb and the overlap size La, Lb (X=Sn+L). Therefore, the span Sna, Snb should be smaller than the first distance Xa, Xb in order for the two adjacent razor blades to overlap each other.

FIG. 6A illustrates two adjacent conventional razor blades, and FIG. 6B illustrates two adjacent razor blades according to an embodiment of the inventive concept. Here, the razor blades of FIG. 6A and FIG. 6B have the same thickness t, inner radius of curvature R (see FIG. 4), angle A (see FIG. 4) and second distance Y (height, see FIG. 4) but different first distances Xa and Xb. In addition, first distances Xa of the razor blades of FIG. 6A are 1.2 mm, and a span Sna formed by the razor blades of FIG. 6A is 0.5 mm. In addition, first distances Xb of the razor blades of FIG. 6B are 0.7 mm, and a span Snb formed by the razor blades of FIG. 6B is 0.5 mm.

As a result, an overlap size La formed by the razor blades of FIG. 6A is 0.7 mm, and an overlap size Lb formed by the razor blades of FIG. 6B is 0.2 mm. As apparent from the above result, despite the same span, a reduction in the first distance X reduces the overlap size L, thereby improving openness between the razor blades.

Therefore, when the first distance X between a virtual straight line extending from the front of a base portion 230 in the vertical direction and an end point of a cutting edge 211 is relatively small, i.e., in the range of 0.3 to 1.0 mm in each of the razor blades 200, the overlap size L defined as a distance between a straight line extending from the front of a base portion of a razor blade and an end point of a cutting edge of an adjacent razor blade located behind the razor blade is relatively small, i.e., in the range of more than 0 to 0.5 mm (0 mm<L≤0.5 mm). Accordingly, even if a narrow span Sn is formed by the installation of a large number of razor blades 200 in the housing 100, the rinsing efficiency of the razor can be maintained or improved due to the small overlap size L.

The overlap size L greater than 0.5 mm reduces the span Sn too much, thereby degrading rinsing efficiency. In addition, it has been experimentally proven that the shaving performance and the rinsing efficiency are relatively superior when the overlap size L is in the range of 0.01 to 0.25 mm in a case where the first distance X is in the range of 0.3 to 1.0 mm. Therefore, the overlap size L may be in the range of 0.01 to 0.25 mm.

In addition, Table 2 shows some information about conventional razor cartridges and razor cartridges according to the inventive concept. Referring to Table 2 below, razor blades in the conventional razor cartridges have relatively large first distances X exceeding 1.0 mm and overlap sizes L distributed in the range of 0.4 to 0.7 mm, i.e., all exceeding 0.3 mm. On the other hand, razor blades 200 in the razor cartridges according to the inventive concept have first distances X in the range of 0.5 to 0.9 mm, roughly in the range of 0.3 to 1.0 mm, and overlap sizes L in the range of 0.1 to 0.3 mm.

TABLE 2

| | Number of blades | Sn | L | X |
|---|---|---|---|---|
| Conventional razor cartridge sample 1 | 5 | 1.0 mm | 0.54 mm | 1.54 mm |
| Conventional razor cartridge sample 2 | 7 | 0.8 mm | 0.4 mm | 1.2 mm |
| Conventional razor cartridge sample 3 | 7 | 0.5 mm | 0.7 mm | 1.2 mm |
| Razor cartridge sample 1 according to the inventive concept | 7 | 0.4 mm | 0.1 mm | 0.5 mm |
| Razor cartridge sample 2 according to the inventive concept | 7 | 0.5 mm | 0.2 mm | 0.7 mm |
| Razor cartridge sample 3 according to the inventive concept | 7 | 0.6 mm | 0.3 mm | 0.9 mm |

In addition, despite a narrow span Sn and a small overlap size L, a reduction in a tunnel size u (see FIGS. 7A and 7B) formed by two adjacent razor blades not only reduces the rinsing efficiency of the razor but also reduces shaving performance because hair gets caught between the razor blades during shaving. Accordingly, for the sake of the shaving performance and the rinsing efficiency, a razor cartridge needs to be designed in view of the tunnel size u as well as the span Sn and the overlap size L. Here, the tunnel size u may be defined as a minimum distance from the rear of a razor blade to a cutting edge of an adjacent razor blade located behind the razor blade. That is, the tunnel size u is the size of an entrance between two adjacent razor blades through which a rinsing solution is introduced. Therefore, the larger the tunnel size u, the better the rinsing efficiency of the razor. If the overlap size L is also factored in, the smaller the overlap size L and the larger the tunnel size u, the better the openness between the razor blades, thereby improving the rinsing performance and the shaving comfort.

The tunnel size u is related to the first distances X of the razor blades 200 to a certain degree. Referring to FIGS. 6A and 6B, the razor blades of FIGS. 6A and 6B have the same thickness t, radius of curvature R, angle A and second distance Y (height, see FIG. 4) but different first distances Xa and Xb. When the first distances Xb are small as in FIG. 6B, the tunnel size ub may be formed as a minimum distance from a bent portion 220 of a razor blade 200 to a cutting edge 211 of a blade razor 200 located behind the razor blade 200. On the other hand, when the first distances Xa are large as in FIG. 6A, the tunnel size ua may be formed as a distance from the rear of an edge portion 210 of a razor blade 200 to a cutting edge 211 of a razor blade 200 located behind the razor blade 200. Therefore, when the first distances Xb are small, the tunnel size ub may be large. (ua<ub)

In addition, the tunnel size u may be affected by an angle formed by an edge portion 210 and a base portion 230 of a razor blade 200. This will now be described with reference to FIGS. 7A and 7B. Here, razor blades of FIGS. 7A and 7B have the same thickness t, radius of curvature R (see FIG. 4), first distance X1 and X2 and second distance Y (height, see FIG. 4) but different angles A11, A12, A21 and A22, wherein only the angle A22 is different from the angles A11, A12 and A21. In addition, the angles A11 and A12 of FIG. 7A and the angle A21 of FIG. 7B are equal, and the angle A22 of FIG. 7B is greater than the angles A11, A12 and A21. Therefore, since the angle A22 of the rearmost razor blade of FIG. 7B is greater than those of the other razor blades, a tunnel size u2 of FIG. 7B is greater than a tunnel size u1 of FIG. 7A (u1<u2).

In addition, a razor cartridge 10 according to an embodiment includes a plurality of razor blades 200*a* through 200*g*. The razor blades 200*a* through 200*g* include a first razor blade group $G_1$ including at least two razor blades 200*a* through 200*c* adjacent to a guard 100*a* and a second razor blade group $G_2$ including at least two razor blades 200*d* through 200*g* adjacent to a cap 100*b*. The razor blades 200*a* through 200*c* of the first razor blade group $G_1$ come into contact with the skin at an initial stage of shaving, and the razor blades 200*d* through 200*g* of the second razor blade group $G_2$ come into contact with the skin at a later stage of shaving.

Overlap sizes L1 through L3 formed on the razor blades 200*a* through 200*c* of the first razor blade group $G_1$ are smaller than overlap sizes L4 through L6 formed on the razor blades 200*d* through 200*g* of the second razor blade group $G_2$. On the other hand, spans Sn1 through Sn3 formed by the razor blades 200*a* through 200*c* of the first razor blade group $G_1$ are greater than spans Sn4 through Sn6 formed by the razor blades 200*d* through 200*g* of the second razor blade group $G_2$. Since relatively long hairs are cut at the initial stage of shaving, a narrow span Sn can cause double engagement. In addition, since a relatively large amount of residues are created at the initial stage of shaving, a narrow span Sn can reduce rinsability. Therefore, if the spans Sn1 through Sn3 of the first razor blade group are relatively large, the double engagement at the initial stage of shaving can be minimized, while the rinsing efficiency of the razor is improved. In addition, if the spans S4 through Sn6 of the second razor blade group are relatively narrow, short hairs which fail to be cut by the first razor blade group can be cut, thus providing a safe and smooth shaving feeling. Here, the double engagement refers to a phenomenon in which two or more razor blades engage with the same hair. The double engagement can cause a razor user to feel tight.

Figure 9:
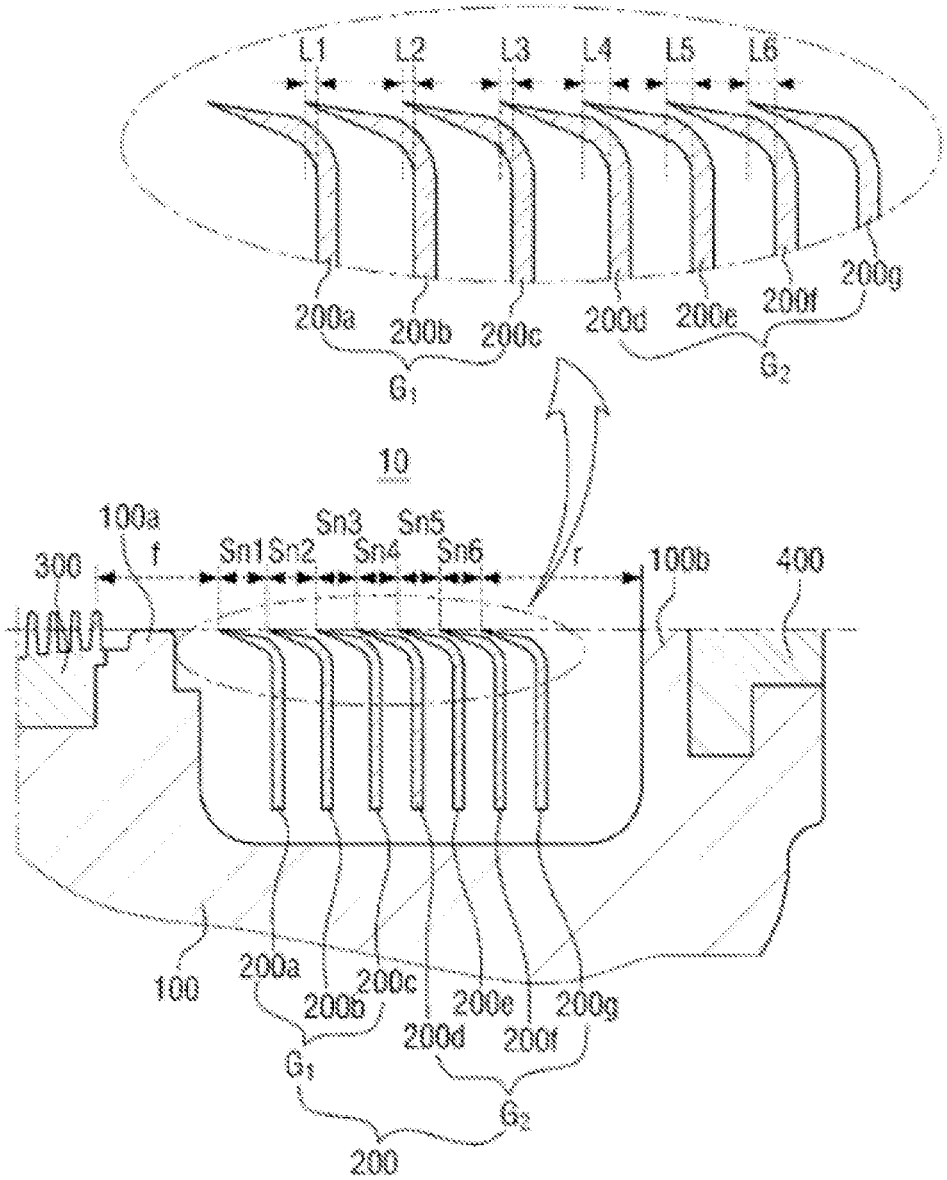
FIG. 9 is a side cross-sectional view explaining the span and overlap of the first razor blade group and the second razor blade group of a razor cartridge according to an embodiment.

Referring to FIG. 9 for a better understanding for the above description, the first razor blade group $G_1$ includes a first razor blade 200*a*, a second razor blade 200*b* and a third razor blade 200*c*, and the second razor blade group $G_2$ includes the fourth razor blade 200*d*, a fifth razor blade 200*e*, a sixth razor blade 200*f* and a seventh razor blade 200*g*.

In addition, L1, L2 and L3 formed on the razor blades of the first razor blade group $G_1$ are smaller than L4, L5 and L6 formed on the razor blades of the second razor blade group $G_2$. On the other hand, Sn1, Sn2 and Sn3 formed by the razor blades 200*a* through 200*c* of the first razor blade group $G_1$ are greater than Sn4, Sn5 and Sn6 formed by the razor blades 200*d* through 200*g* of the second razor blade group $G_2$. This is because the overlap sizes L and the spans Sn are inversely proportional to each other in a case where the first distances X of the razor blades 200 are fixed.

In addition, each of the first razor blade group $G_1$ and the second razor blade group $G_2$ includes at least plurality of razor blades (two razor blades) to form a plurality of overlap sizes. In an embodiment, the overlap sizes L1 through L3 formed on the razor blades 200*a* through 200*c* of the first razor blade group $G_1$ are all equal. In addition, the overlap sizes L4 through L6 formed on the razor blades 200*d* through 200*g* of the second razor blade group $G_2$ are all equal. That is, L1=L2=L3<L4=L5=L6, and Sn1=Sn2=Sn3>Sn4=Sn5=Sn6.

In other embodiment, the overlap sizes L1 through L3 formed on the razor blades 200*a* through 200*c* of the first razor blade group $G_1$ are all equal. In addition, the overlap sizes L4 through L6 formed on the razor blades 200*d* through 200*g* of the second razor blade group $G_2$ gradually increase toward the cap. That is, L1=L2=L3<L4<L5<L6, and Sn1=Sn2=Sn3>Sn4>Sn5>Sn6.

In another embodiment, the overlap sizes L1 through L3 formed on the razor blades 200*a* through 200*c* of the first razor blade group $G_1$ gradually increase toward the cap. In addition, the overlap sizes L4 through L6 formed on the razor blades 200*d* through 200*g* of the second razor blade group $G_2$ gradually increase toward the cap. That is, L1<L2<L3<L4<L5<L6, and Sn1>Sn2>Sn3>Sn4>Sn5>Sn6.

The razor cartridge 10 having the overlap sizes L that at least partially gradually increase toward the cap can form smaller cartridge dimensions without degrading shaving performance than a razor cartridge having equal overlap sizes L between an equal number of razor blades to the number of razor blades included in the razor cartridge 10.

In addition, in the razor cartridge 10, a distance f between a cutting edge 211 of the razor blade 200*a* adjacent to the guard 100*a* and the guard 100*a* is in the range of 0.1 to 0.8 mm, and a distance r between a cutting edge 211 of the razor blade 200*g* adjacent to the cap 100*b* and the cap 100*b* is in the range of 0.5 to 2.5 mm. That is, the distance between the first razor blade and the guard is in the range of 0.1 to 0.8 mm, and the distance between the seventh razor blade and the cap is in the range of 0.5 to 2.5 mm.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A razor cartridge comprising:

a housing which comprises a guard and a cap; and a plurality of razor blades which are installed between the guard and the cap in the housing, wherein each of the plurality of razor blades comprises a base portion, a bent portion extending from an end of the base portion, and an edge portion extending from an end of the bent portion and having a cutting edge formed at an end of the edge portion, wherein each of the plurality of razor blades is secured in the razor cartridge in a lateral direction, and wherein each of the plurality of razor blades defines a straight line aligned with a front of the base portion of the razor blade, wherein for each two adjacent blades of the plurality of razor blades, an overlap size between the two adjacent blades is defined as a distance between the straight line aligned with the front of the base portion of a first razor blade of the two adjacent blades and an end point of the cutting edge of a second razor blade of the two adjacent blades located behind the first razor blade, wherein each overlap size for the plurality of blades ranges more than 0 and less than or equal to 0.5 mm, wherein for each of the plurality of razor blades, a first distance (X) between the straight line aligned with the front of the base portion of the razor blade and an end point of the cutting edge of the razor blade is in the range of 0.3 to 0.85 mm, wherein for each of the plurality of razor blades, an inner curvature of the bent portion of the razor blade is in the range of 0.55 mm to 0.9 mm, wherein for each of the plurality of razor blades, a thickness of the razor blade at the bent portion is less than a thickness of the razor blade at the base portion, wherein for each of the plurality of razor blades, the razor blade is convexly curved toward a front of the razor cartridge such that a middle portion of the cutting edge along a lengthwise direction of the razor blade curvedly extends past a lengthwise straight line connecting opposite ends of the cutting edge, wherein the plurality of razor blades comprises a first razor blade group adjacent to the guard comprising at least two spans between razor blades of the first razor blade group, wherein the at least two spans of the first razor blade group are equal to each other and the overlap sizes between the razor blades of the first razor blade group are equal to each other, wherein the plurality of razor blades further comprises a second razor blade group adjacent to the cap and comprising at least two spans between razor blades of the second razor blade group, wherein the at least two spans of the second razor blade group are equal to each other and the overlap sizes between the razor blades of the second razor blade group are equal to each other, and wherein a number of the plurality of razor blades is at least five and the overlap sizes between the razor blades of the first razor blade group are smaller than the overlap sizes between the razor blades of the second razor blade group.

2. The razor cartridge of claim 1, wherein a distance between the cutting edge of one of the razor blades adjacent to the guard and the guard is in the range of 0.1 to 0.8 mm, and a distance between the cutting edge of another of the razor blades adjacent to the cap and the cap is in the range of 0.5 to 2.5 mm.

3. The razor cartridge of claim 1, wherein each of the overlap sizes of the plurality of blades is in the range of 0.01 to 0.25 mm.

4. The razor cartridge of claim 1, wherein the plurality of blades includes a maximum of 10 razor blades.

5. A razor comprising:

a handle; and a razor cartridge coupled to the handle, wherein the razor cartridge comprises:

a housing which comprises a guard and a cap; and a plurality of razor blades which are installed between the guard and the cap in the housing, wherein each of the plurality of razor blades comprises a base portion, a bent portion extending from an end of the base portion, and an edge portion extending from an end of the bent portion and having a cutting edge formed at an end of the edge portion, wherein each of the plurality of razor blades is secured in the razor cartridge in a lateral direction, and wherein each of the plurality of razor blades defines a straight line aligned with a front of the base portion of the razor blade, wherein for each two adjacent blades of the plurality of razor blades, an overlap size between the two adjacent blades is defined as a distance between the straight line aligned with the front of the base portion of a first razor blade of the two adjacent blades and an end point of the cutting edge of a second razor blade of the two adjacent blades located behind the first razor blade, wherein each overlap size for the plurality of blades ranges more than 0 and less than or equal to 0.5 mm, wherein for each of the plurality of razor blades, a first distance (X) between the straight line aligned with the front of the base portion of the razor blade and an end point of the cutting edge of the razor blade is in the range of 0.3 to 0.75 mm, wherein for each of the plurality of razor blades, an inner curvature of the bent portion of the razor blade is in the range of 0.55 mm to 0.9 mm, wherein for each of the plurality of razor blades, a thickness of the razor blade at the bent portion is less than or substantially equal to a thickness of the razor blade at the base portion, wherein for each of the plurality of razor blades, the razor blade is convexly curved toward a front of the razor cartridge such that a middle portion of the cutting edge along a lengthwise direction of the razor blade curvedly extends past a lengthwise straight line connecting opposite ends of the cutting edge, wherein the plurality of razor blades comprises a first razor blade group adjacent to the guard comprising at least two spans between razor blades of the first razor blade group, wherein the at least two spans of the first razor blade group are equal to each other and the overlap sizes between the razor blades of the first razor blade group are equal to each other, wherein the plurality of razor blades further comprises a second razor blade group adjacent to the cap and comprising at least two spans between razor blades of the second razor blade group, wherein the at least two spans of the second razor blade group are equal to each other and the overlap sizes between the razor blades of the second razor blade group are equal to each other, and wherein a number of the plurality of razor blades is at least five and the overlap sizes between the razor blades of the first razor blade group are smaller than the overlap sizes between the razor blades of the second razor blade group.

6. The razor of claim 5, wherein a distance between the cutting edge of one of the razor blades adjacent to the guard and the guard is in the range of 0.1 to 0.8 mm, and a distance between the cutting edge of another of the razor blades adjacent to the cap and the cap is in the range of 0.5 to 2.5 mm.

7. The razor of claim 5, wherein each of the overlap sizes of the plurality of blades is in the range of 0.01 to 0.25 mm.

8. The razor of claim 5, wherein the plurality of blades includes a maximum of 10 razor blades.

* * * * *